United States Patent [19]

Hayashi et al.

[11] 4,021,238

[45] May 3, 1977

[54] PROCESS OF FORMING COLOR PHOTOGRAPHIC IMAGES

[75] Inventors: Jun Hayashi; Takeshi Kato; Atsuaki Arai, all of Minami-ashigara, Japan

[73] Assignee: Fuji Photo Film Co., Ltd., Minami-ashigara, Japan

[22] Filed: Jan. 22, 1975

[21] Appl. No.: 543,091

[30] Foreign Application Priority Data

Jan. 22, 1974 Japan ..... 49-9566

[52] U.S. Cl. ..... 96/22; 96/55; 96/56.5; 96/64; 96/68; 96/74; 96/100

[51] Int. Cl.[2] ..... G03C 7/16

[58] Field of Search ..... 96/74, 22, 55, 64, 68

[56] References Cited

UNITED STATES PATENTS

| | | | |
|---|---|---|---|
| 3,148,062 | 9/1964 | Whitmore et al. | 96/74 |
| 3,227,551 | 1/1966 | Barr et al. | 96/74 |
| 3,227,554 | 1/1966 | Barr et al. | 96/74 |
| 3,582,347 | 6/1971 | Holly et al. | 96/22 |
| 3,846,128 | 11/1974 | Thomas et al. | 96/68 |
| 3,862,842 | 1/1975 | Bissonette | 96/64 |

*Primary Examiner*—J. Travis Brown

*Attorney, Agent, or Firm*—Sughrue, Rothwell, Mion, Zinn & Macpeak

[57] ABSTRACT

A process for forming color photographic images which comprises color-developing at temperatures higher than about 30° C a multilayer color photographic material comprising a support having thereon at least two photosensitive emulsion layers each containing a coupler which can form a non-diffusible colored dye on coupling with the oxidation product of an aromatic primary amino color developing agent and at least one fogged emulsion layer containing a coupler which can form a non-diffusible colored dye on coupling with the oxidation product of an aromatic primary amino color developing agent.

12 Claims, No Drawings

PROCESS OF FORMING COLOR PHOTOGRAPHIC IMAGES

BACKGROUND OF THE INVENTION

1. FIELD OF THE INVENTION

The present invention relates to a process of forming color photographic images having improved color reproduction, and in particular, the invention relates to a process of forming color photographic images having improved color reproduction for multilayer color photographic materials containing, as at least a color coupler, an acylacetamide compound of which one active hydrogen at the alpha-position has been substituted by a releasable group at coupling.

2. DESCRIPTION OF THE PRIOR ART

A multilayer color photographic material usually comprises a silver halide photosensitive emulsion layer containing a yellow coupler and which is sensitive mainly to blue light (light of a wavelength of substantially shorter than about 500 nm), a silver halide photosensitive emulsion layer containing a magenta coupler and which is sensitive mainly to green light (light of a wavelength of substantially about 500 to 600 nm), and a silver halide photosensitive emulsion layer containing a cyan coupler and which is sensitive mainly to red light (light of a wavelength longer than about 590 nm). Each of the photoensitive emulsion layers must function independently for color reproduction. To obtain this result, intermediate layers, a filter layer to light including ultraviolet light, an antihalation layer, and a protective layer are formed in the color photographic material in addition to the above-described silver halide photosensitive emulsion layers.

Furthermore, each silver halide photosensitive emulsion layer must contain a coupler which provides a dye image having an appropriate spectral sensitivity distribution and an appropriate spectral absorption in a specific wavelength region. However, present color photographic materials still have many defects as shown below.

The first defect in color reproduction is in the spectral absorption characteristics of the colored dye image formed from the coupler, in that the dye image does not have sufficient absorption in a specific wavelength region and has unnecessary absorption in other wavelength regions. Such a defect narrows the color reproduction region and also causes a shift in the hue and a reduction in saturation. The second defect is that the development of a specific silver halide photosensitive emulsion layer induces the coloring of couplers in adjacent silver halide emulsion layers. This disadvantage causes color mixing and reduces, in particular, saturation. The third defect is that a sensitizing dye used for spectrally sensitizing a specific silver halide emulsion layer diffuses into an adjacent silver halide emulsion layer to sensitize the adjacent layer, whereby the silver halide emulsion layer has an inappropriate spectral sensitivity distribution.

As a method of improving these defects, a method of forming intermediate layers and a filter layer and also a method wherein a reducing agent such as a hydroquinone derivative, a phenol derivative, an ascorbic acid derivative, a scavenger for the oxidation product of a color developing agent which is an aromatic primary compound, a colorless coupler, a coupler forming a diffusible dye, and a sensitizing dye or a diffusion preventing agent for a coupler such as fine silver halide grains, a clay such as colloidal silica and hectorite, an anionic surface active agent, a nonionic surface active agent, a cationic surface active agent, a cationic hydrophilic synthetic polymer, a hydroquinone derivative-containing hydrophilic polymer, and a polymer latex incorporated in an intermediate layer or a filter layer, are known. However, the improvement with such methods is still insufficient.

Another method of improving the occurence of "color mixing" is the introduction of a photographic element positively equipped with a "color correction" function. The first attempt of this nature is a method of using a colored coupler equipped with an automatic masking funtion as described in, for instance, the specifications of U.S. Pat. Nos. 2,455,170; 2,449,966; 2,600,788; 2,428,054; 3,148,062; and 2,983,608 and British Pat. No. 1,044,778. However, the use of the colored coupler tends to increase the formation of fog, which degrades the granularity of the dye image formed, and hence the use of such a coupler is generally limited.

The second attempt is a method of using a so-called "DIR coupler (development inhibitor releasing coupler)". A DIR coupler is a coupler defined in D. R. Barr, J. R. Thirtle, and P. W. Vittum, *Photographic Science and Eng.*, Vol. 13, 74 ~ 80 (1969); ibid., 214 - 217 (1969); and U.S. Pat. No. 3,227,554. It is generally known that the DIR coupler provides an interimage effect but has the disadvantages that it delays the development, reduces the gradation (gamma), reduces the maximum color density (Dmax), and reduces the effective sensitivity.

The third attempt is a method of using a substantially fogged silver halide emulsion as an intermediate layer. This method, however, generally provides a low effect in improving the color reproduction and, in particular, when the amount of silver halide is reduced in at least one silver halide photosensitive sensitive emulsion layer using therein a color coupler having a high coupling ability, the method tends to provide substantially no effect in improving color reproduction. Furthermore, an ordinary multilayer color photographic material has, from the support side, a red-sensitive silver halide emulsion layer, a green-sensitive silver halide emulsion layer, and a blue-sensitive silver halide emulsion layer on a support and in such a case the sharpness of the green-sensitive silver halide emulsion layer and the red-sensitive silver halide emulsion layer disposed under the blue-sensitive silver halide emulsion layer is reduced due to light scattering by the the silver halide grains in the blue-sensitive silver halide emulsion layer (in this proposed attempt). The reduction in sharpness can be, however, improved because, as will be explained hereinafter in detail, when an acylacetamide compound in which at least one active hydrogen at the alpha-position having a high coupling ability has been substituted by a releasable group at coupling is used as a coupler in place of an acylacetamide compound in which the alpha-position has not been substituted, the amount of the silver halide incorporated in the blue-sensitive silver halide emulsion layer can be generally reduced to about a half that generally required. By employing the aforesaid technique, the sharpness of the green-sensitive halide emulsion layer and the red-sensitive silver halide emulsion layer can be remarkably increased, but as described above the aforesaid third attempt tends to provide almost no effect in improving color reproduction. As described above, if improving the sharpness of the silver halide emulsion layers using a fogged silver halide emulsion in the intermediate layers in intended, the effect of improving color reproduction becomes poor and thus it has been difficult to obtain high sharpness and good color reproduction simultaneously using the third attempt as proposed heretofore.

SUMMARY OF THE INVENTION

A first object of this invention is to provide a process for remarkably increasing the effect of improving color reproduction in a photographic material containing a substantially fogged silver halide emulsion as an intermediate layer.

A second object of this invention is to provide a process for improving color reproduction when an acylacetamide compound in which at least one active hydrogen at the alphaposition has been substituted by a releasable group is used as a coupler as will be explained hereinafter.

A third object of this invention is to provide a process for providing color photographic images having high sharpness and improved color reproduction.

These objects of this invention are attained by employing the following process of this invention. This is, the present invention provides a process for forming color photographic images which comprises color developing at temperatures higher than about 30+ C a multilayer color photographic material comprising a support having thereon at least two photosensitive emulsion layers each containing a coupler which is capable of forming a non-diffusible colored dye by coupling with the oxidation product of an aromatic primary amino color developing agent and at least one fogged emulsion layer containing a coupler which is capable of forming a non-diffusible colored dye by coupling with the oxidation product of an aromatic primary amino color developing agent.

DETAILED DESCRIPTION OF THE INVENTION

The multilayer color photographic material as described above is already known, e.g., as described in U.S. Pat. No. 3,227,554, but when the color photographic material is subjected to color development at a temperature of 21° C as described in the specification of this U.S. patent, a good effect of improving color reproduction is not obtained. Similarly, when a multilayer color photographic material which does not have the aforesaid fogged emulsion layer is color-developed at temperature higher than 30° C, a good effect of improving color reproduction is not obtained. That is, it is quite important to color-develop the above-described multilayer color photographic material having the fogged emulsion layer at temperatures higher than about 30° C according to the teaching of the present invention, and it is unexpected and astonishing that a remarkably improved color reproduction is obtained only when the above-described combination is processed according to this invention.

Suitable couplers used in this invention are compounds which form color on coupling by color development with an aromatic primary amino color developing agent such as, for instance, a phenylenediamine derivative and an aminophenol derivative. Examples of such couplers are 5-pyrazolone couplers, cyanoacetylocoumarone couplers, open-chain acylacetonitrile couplers, acylacetyl couplers, acylacetanilide couplers (e.g., alkylacetanilide couplers, aroylacetanilide couplers, and pivaloylacetanilide couplers), naphthol couplers, and phenol couplers. More specifically, as the magenta coupler, the 5-pyrazolone couplers, cyanoacetylcoumarone couplers, indazolone couplers, etc., are used and, in particular, the magenta couplers represented by general formula (I) are useful;

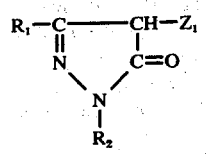

(I)

wherein $R_1$ represents a primary, secondary, or tertiary alkyl group (e.g., a methyl group, a propyl group, an n-butyl group, a t-butyl group, a hexyl group, a 2-hydroxyethyl group, a 2-phenylethyl group, etc.), an aryl group, a heterocyclic group (e.g., a quinolinyl group, a pyridyl group, a benzofuranyl group, an oxazolyl group, etc.), an amino group (e.g., a methylamino group, a diethylamino group, a phenylamino group, a tolylamino group, a 4-(3-sulfonbenzamino)anilino group, a 2-chloro-5-acylaminoanilino group, a 2-chloro-5-alkoxycarbonylanilino group, a 2-trifluoromethylphenylamino group, etc.), a carbonamido group (e.g., an alkylcarbonamido group such as an ethylcarbonamido group, an arylcarbonamide group, a heterocyclic carbonamido group such as a benzothiazolylcarbonamido group), a sulfonamido group (e.g., a sulfonamido group, an alkylsulfonamido group, an arylsulfonamido group, a heterocyclic sulfonamido group, etc.), or a ureido group (e.g., an alkylureido group, an arylureido group, a heterocyclic ureido group, etc.); $R_2$ represents an aryl group (e.g., a naphthyl group, a phenyl group, a 2,4,6-trichlorophenyl group, a 2-chloro-4,6-dimethylphenyl group a 2,6-dichloro-4-methoxyphenyl group, a 4-methylphenyl group, a 4-acylaminophenyl group, a 4-alkylaminophenyl group, a 4-trichloromethylphenyl group, a 3,5-dibromophenyl group, etc.) or a heterocyclic group (e.g., a benzofuranyl group, a naphthoxazolyl group, a quinolinyl group, etc.); and $Z_1$ represents a hydrogen atom or a group which can be released at coupling.

As the yellow couplers used in this invention, for instance, open-chain acylacetanilide couplers (e.g., pivaloyl acetanilide couplers, aroylacetanilide couplers, etc.) and open chain acetonitrile couplers can be used. In particular, useful yellow couplers are represented by general formula (II);

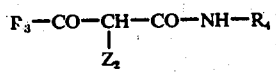

(II)

wherein $R_3$ represents a primary alkyl group having 1 to 18 carbon atoms, a secondary group, a tertiary alkyl group (e.g., a t-butyl group, a 1,1-dimethylpropyl group, a 1,1-dimethyl-1-methoxyphenoxymethyl group, etc.), or an aryl group (e.g., a phenyl group, an alkylphenyl group such as a 3-methylphenyl group, a 3-octadecylphenyl group, etc., an alkoxyphenyl group such as a 2-methoxyphenyl group, a 4-methoxyphenyl group, etc.), a halophenyl group, a 2-halo-5-alkamidophenyl group, a 2-chloro-5-[α-(2,4-di-t-amylphenoxy)-butyramido]phenyl group, a 2-methoxy-5-alkamidophenyl group, a 2-chloro-5-sulfonamidophenyl group, etc.); $R_4$ represents an aryl group (e.g., a 2-chlorophenyl group, a 2-halo-5-alkamidophenyl group, a 2-chloro-5-[α-(2,4-di-t-amylphenoxy)acetamido]phenyl group, a 2-chloro-5-(4-methylphenylsulfonamido)phenyl group, a 2-methoxy-5-(2,4-di-t-amylphenoxy)acetamidophenyl group); and $Z_2$ represents a hydrogen atom or a group which can be released at coupling.

The cyan couplers used in this invention are, for instance, naphthol couplers and phenol couplers. In particular, useful cyan couplers are represented by general formula (III) or (IV);

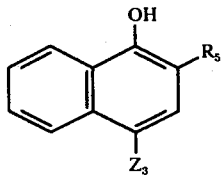

(III)

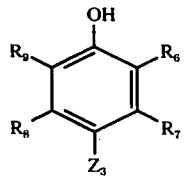

(IV)

wherein $R_5$ represents a substituent generally used for cyan couplers such as, for instance, a carbamyl group (e.g., an alkylcarbamyl group, an arylcarbamyl group such as a phenylcarbamyl group, a heterocyclic carbamyl group such as a benzothiazolycarbamyl group, etc.), a sulfamyl group (e.g., an alkylsulfamyl group, an arylsulfamyl group such as phenylsulfamyl group, a heterocyclic sulfamyl group, etc.), an alkoxycarbonyl group, and an aryloxycarbonyl group; $R_6$ represents an alkyl group, an aryl group, a heterocyclic group, an amino group (e.g., an amino group, an alkylamino group, an arylamino group, etc.), a carbonamido group (e.g., an alkylcarbonamido group, an arylcarbonamide group, a heterocyclic carbonamido group, etc.), a sulfonamido group, a sulfamyl group (e.g., an alkylsulfamyl group, an arylsulfamyl group, etc.), or a carbamyl group; $R_7$, $R_8$, and $R_9$ each represents the groups as defined for $R_6$, and further a halogen atom, or an alkoxy group; and $Z_3$ represents a hydrogen atom or a group which can be released by coupling.

The couplers used in this invention can be four-equivalent couplers or two-equivalent couplers used for conventional color photographic materials and they can also be uncolored couplers or colored couplers. For instance, $Z_1$, $Z_2$, and $Z_3$ in general formulae (I), (II), (III), and (IV) each represents a hydrogen atom or a group which can be released at coupling, but is particularly preferably a group rendering the coupler a two-equivalent coupler.

For instance, $Z_1$ represents a hydrogen atom, an acyloxy group, an aryloxy group, a halogen atom, a thiocyano group, a di-substitued amino group, an aryloxycarbonyloxy group, an alkoxycarbonyloxy group, a benzotriazolyl group, an indazolyl group, an arylazo group, and a heterocyclic azo group. Examples of couplers having such groups are described in the specifications of U.S. Pat. Nos. 3,227,550; 3,252,924; 3,311,476; and 3,419,391 and German Patent Application OLS 2,015,867.

Furthermore, $Z_1$ can be a residue which releases a development inhibitor at development such as an arylmonothio group (e.g., a 2-aminophenylthio group, a 2-hydroxycarbonylphenylthio group, etc.), a heterocyclic monothio group (e.g., a tetrazolyl group, a triazinyl group, a triazolyl group, an oxazolyl group, an oxadiazolyl group, a diazolyl group, a thiazyl group, etc.), and a heterocyclic imido group (e.g., a 1-benzotriazolyl group, a 1-indazolyl group, a 2-benzotraizolyl group, etc.). Examples of these groups are described further in the specifications of U.S. Pat. Nos. 3,148,062; 3,227,554; 3,615,506; and 3,701,783; and German Patent Application OLS 2,414,006.

$Z_2$ represents a hydrogen atom, a halogen atom (in particular, a fluorine atom), an acyloxy group, an aryloxy group, a heterocyclic aromatic carbonyloxy group, a sulfimido group, an alkysulfoxy group, a phthalimido group, a dioxoimidazolidinyl group, a dioxooxazolidinyl group, an indazolyl group, a dioxothiazolidinyl group, and the like. Examples of these groups are described in U.S. Pat. Nos. 3,227,550; 3,253,924; 3,277,155; 3,265,506, 3,408,194; and 3,415,652; French Pat. No. 1,411,384; British Pat. Nos. 944,490; 1,040,710; and 1,118,028; and German Patent Application OLS 2,057,941; 2,163,812; and 2,219,917.

$Z_2$ can also be a residue which releases a development inhibitor at development, such as, for instance, an arylmonothio group (e.g., phenylthio group, a 2-carboxyphenylthio group, etc.), a heterocyclic thio group, a 1-benzotriazolyl group, and 1-benzodiazoyl group.

$Z_2$ represents a hydrogen atom, a halogen atom (e.g., a chlorine atom, a bromine atom, etc.), an indazolyl group, a cyclic imido group, an acyloxy group, an aryloxy group, an alkoxy group, a sulfo group, an arylazo group, and a heterocyclic azo group. Examples of these groups are described in the specifications of U.S. Pat. Nos. 2,423,730; 3,227,550 and 3,311,476 and British Pat. Nos. 1,084,480 and 1,165,563. Also, $Z_3$ can be a residue which can release a development inhibitor at development, such as an arylmonothio group (e.g., a phenylthio group, a 2-carboxyphenylthio group, etc.), a heterocyclic thio group, a 1-benzotriazolyl group, and a 1-benzodiazolyl group; and also the residues as described in German Patent Application OLS 2,414,006.

The couplers used in this invention can be colored couplers and examples of suitable colored couplers are described in, for instance, the specifications of U.S. Pat. Nos. 2,983,608; 3,005,712; and 3,034,892; British Pat. Nos. 937,621; 1,269,073; 5,86,211; and 627,814; and French Pat. Nos. 980,372; 1,091,903; 1,257,887; 1,398,308 and 2,015,649.

Specific examples of couplers which can be used in this invention are illustrated below but it is to be understood that the couplers in this invention are not to be construed as being limited to these couplers.

Yellow Couplers

1. α-{3-[α-(2,4-Di-tert-amylphenoxy)butyramido]-benzoyl}-2-methoxyacetanilide
2. α-Acetoxy-α-{3-[γ-(2,4-di-tert-amylphenoxy)-butyramido]-benzoyl}-2-methoxyacetanilide
3. N-(4-Anisoylacetamidobenzenesulfonyl)-N-benzyl-N-toluidine
4. α-(2,4-Dioxo-5,5-dimethyloxazolidinyl)-α-pivaloyl-2-chloro-5-[α-(2,4-di-tert-amylphenoxybutyramido]acetanilide 5. α-(4-Carboxyphenoxy)-α-pivaloyl-2-chloro-5-[α-(2,4-di-tert-amylphenoxy)butyramido]acetanilide
6. α-[3-(1-Benzyl)hydantoinyl]-αpivaloyl-2-chloro-5-[α-(2,4-di-tert-amylphenoxy)-butyramido]acetanilide Magenta Couplers 7. 1-(2,4,6-Trichlorophenyl)-[3-(2,4-di-tert-amylphenoxy-acetamido)benzamido]-5-pyrazolone
8. 1-(2,4,6-Trichlorophenyl)3-[3-(2,4-di-tert-amylphenoxyacetamido)benzamido]-4-acetoxy-5-pyrazolone
9. 1-(2,4,6-Trichlorophenyl)-3-n-tetradecaneamido-4-(4-hydroxyphenylazo)-5-pyrazolone
10. 1-(2,4,6-Trichlorophenyl)-3-(5-n-tetradecaneamido-2-chloroanilino)-5-pyrazolone
11. 1-(2,4,6-Trichlorphenyl)-3-(5-tetradecyloxycarbonyl-2-chloroanilino)-4-(1-naphthylazo)-5-pyrazolone
12. 1-(2,4-Dichloro-6-methoxyphenyl)-3-(5-n-tetradecaneamido-2-chloroanilino)-4-benzyloxycarbonyloxy-5-pyrazolone Cyan Couplers 13. 1-Hydroxy-N-[γ-(2,4-di-tert-amylphenoxy-propyl)]-2-naphthamide
14. 1-Hydroxy-4-[2-(2-hexyldecyloxycarbonyl)-phenylazo]-2-[N-(1-naphthyl)]naphthamide
15. 1-Hydroxy-4-chloro-N-[α-(2,4-di-tert-amylphenoxy)butyl]-2-naphthamide
16. 5-Methyl-4,6-dichloro-2-[α-(3-n-pentadecylphenoxy)butyl-amido]phenol DIR Couplers 17. α-Benzoyl-α-(2-benzothiazolylthio)-4-[N-(γ-phenylpropyl)-N-(4-tolyl)sulfamyl]acetanilide
18. 1-{4-[γ-(2,4-Di-tert-amylphenoxy)butyramido]-phenyl}-3-piperidinyl-4-(1-phenyl-5-tetrazolylthio)-5-pyrazolone
19. 1-(2,4,6-Trichlorophenyl)-3-{4-[α-(2,4-di-tert-amylphenoxy)-butyramido]anilino}-4-(1-phenyl-5-tetrazolylthio)-5-pyrazolone
20. {1- 4-[α-(2,4-Di-tert-amylphenoxy)acetamido]-phenyl}-3-methyl-4-(5 or 6-bromo-1-benztriazoyl-5-pyrazolone
21. 1-Hydroxy-4-iodo-N-dodecyl-2-naphthamide
22. 5-Methoxy-2-[α-(3-n-pentadecylphenoxy)-butyramido]-4-(1-phenyl-5-tetrazolythio)phenol
23. N-[α-(2,4-Di-tert-amylphenoxy)acetyl]-ω-(1-phenyl-5-tetrazolylthio)-m-aminoacetophenone
24. α-Pivaloyl-α-(5 or 6-bromo-1-benztriazolyl)-5-[α-(2,4-di-tert-amylphenoxy)propionamido]-2-chloroacetanilide The couplers used in this invention can be prepared by known methods.

The objects of this invention can be quite effectively attained particularly in the following cases.

That is, the above-described objects of this invention can be attained quite effectively by color-developing at temperatures higher than about 30° C a multilayer color photographic material having on a support at least two photosensitive emulsion layers each containing a coupler which can form a non-diffusible colored dye by coupling with the oxidation product of a primary aromatic amino color developing agent, at least one of the two photosensitive emulsion layers further containing an alpha monosubstituted acylamido yellow coupler, and at least one fogged emulsion layer containing a coupler which can form a nondiffusible colored dye by coupling with the oxidation product of an aromatic primary amino color developing agent.

In this case of color photographic image having an improved color reproduction and at the same time a high sharpness can be obtained.

As the alpha mono-substituted acylamido yellow couplers used in this invention, any acylamido yellow couplers in which the alpha position has been substituted by a group which can be released as an anion at coupling can be used, but the couplers represented by following general formula (V) are particularly useful;

$$R_3-CO-\underset{\underset{Z_4}{|}}{CH}-CO-NH-R_4 \qquad (V)$$

wherein $R_3$ and $R_4$ have the same meaning as defined in general formula (II) and $Z_4$ represents a group which can be released as an anion at coupling.

In general formula (V), $Z_4$ represents a group which does not substantially inhibit development, such as, preferably, a halogen atom (e.g., in particular, a fluorine atom), an acyloxy group, an aryloxy group, a heterocyclic carbonyloxy group, a sulfimido group, an alkylsulfoxy group, an arylsulfoxy group, a phthalimido group, a dioxoimidazolidinyl group, a dioxooxazolidinyl group, an indazolyl group, and a dioxothiazolidinyl group. These described in, for instance, the specifications of U.S. Pat. Nos. 3,227,550; 3,253,924; 3,277,155; 3,265,506; 3,408,194; and 3,415,652; French Pat. No. 1,411,384; British Pat. Nos. 944.490; 1,040,710 and 1,118,028; and German Patent Application OLS 2,057,941; 2,163,812; and 2,219,917.

Typical examples of yellow couplers represented by general formula (V) are shown below but it is to be understood that the yellow couplers used in this invention are not to be construed as being limited to these examples.

25. α-Pivaloyl-α-phthalimido-2-chloro-5-[γ-(2,4-di-tert-amylphenoxy)butyramido]acetanilide
26. α-Pivaloyl-α-(5,5-dimethyl-3-hydantoinyl)-2-chloro-5-[α-(2,4-di-tert-amylphenoxy)-butyramido]acetanilide
27. α-Pivaloyl-α[4-(4-benzyloxybenzenesulfonyl)-phenoxy]-2-chloro-5-[γ-(2,4-di-tert-amylphenoxy)butyramido]acetanilide
28. α-Pivaloyl-α-(4-carboxyphenoxy)-2-chloro-5-[γ-(2,4-di-tert-amylphenoxy)butyramido]acetanilide
29. α-Picaloyl-α-phthalimido-2-chloro-5-n-tetradecyloxycarbonylacetanilide
30. α-Pivaloyl-α-acetoxy-2-chloro-5-[γ-(2,4-di-tert-amylphenoxy)butyramido]acetanilide
31. α-Pivaloyl-α-(benzosulfimido)-2-chloro-5-[γ-(2,4-di-tert-amylphenoxy)butyramido]acetanilide
32. α-(α-p-Toluoxyisobutyryl)-α-(N-succinimido-2-chloro-5-[γ-(2,4-di-tert-amylphenoxy)butylsulfamoyl]acetanilide
33. α-Benzoyl- α-phthalimido-2-methoxy-5-n-tetradecyloxycarbonylacetanilide
34. α-{3 -[α-(2,4-Di-tert-amylphenoxy)butyramido]-benzoyl}-α-(1,3-dioxo-5-n-butoxycarbonyl-2-isoinodolinyl)-2-methoxyacetanilide
35. α-(2-Methylbenzoyl)-α-phthalimido-2-chloro-5-n-dodecyloxycarbonylacetanilide
36. α-(2,4-Dimethoxy)-α-(1,3-dioxo-5-carboxy-2-isoindolinyl)-

37. α-Benzoyl-α-(5,5-dimethyl-3-hydantoinyl)-2-chloro-5-n-dodecyloxycarbonylacetanilide
38. α-(2-Methylbenzoyl)-α-(4-chlorophenoxy)-2-chloro-5-n-dodecyloxycarbonylacetanilide
39. α-(4-Methoxybenzoyl)-α(5,5-dimethyl-3-hydantoinyl)-2-chloro-5-[α-(2,4-di-tert-amylphenoxy)-butyramido]acetanilide 40. α-(4-Methoxybenzoyl)-α-phthalimido-2-chloro-5-[α-(2,4-di-tert-amylphenoxy)butyramido]acetanilide
41. α(4-Methoxybenzoyl)-α-(benzoylphthalimido)-2-chloro-5-[α-(2,4-di-tert-amylphenoxy)-butyramido]acetanilide
42. α-Benzoyl-α-(2,5-dioxo-3-n-hexyl-1-pyrrolidinyl)-2-phenoxy-5-n-tetradecyloxycarbonylacetanilide
43. α-{4-Methoxy-3-[α-(2,4-di-tert-amylphenoxy)-butyramido]-benzoyl}-α-(N-phthalimido)-2-methoxy-5-(N,N-diethylsulfamoyl)acetanilide
44. α-{4-Methoxy-3-[α-(2,4-di-tert-amylphenoxy)-butyramido]-benzoyl}-α-fluoro-2-methoxy-5-(N,N-diethylsulfamoyl)-acetanilide
45. α-(4-Methoxybenzoyl-α-acetoxy-2-chloro-5[2-(2,4-di-tert-amylphenoxy)butyramido]acetanilide
46. α-Benzoyl-α-[1,3-dioxo-5-2,4-di-tert-amylphenoxyacetamido)-2-isoindolinyl]-2methoxyacetanilide
47. α-Pivaloyl-α-(1,3-dioxo-5-n-hexadecanamido-2-isoindolinyl)-2-benzthiazolylacetamide
48. α-(2-Furoyl)-α-diglycolimido-2-chloro-4-[(β-n-valeryl-n-tridecylamino)propionamido)acetanilide
49. bis(α-Terephthaloyl-α-phthalimido-2-methoxy-5-n-octyloxycarbonylacetanilide)
50. 4,4'Methylenebis[α-(3-dodecanamidobenzoyl)-α-(4-benzyloxycarbonylphenoxy-2-chloro-acetnailide]
51. N,N'-bis[Benzoyl-2-methoxy-5-(carbolauryloxy)phenyl-carbamylmethyl]pyromelit-diimide
52. α-Pivaloyl-α-(2,5-dioxo-3-n-octadecyl-1-pyrrolidinyl)-3,5-dicarboxyacetanilide
53. α(4-methoxybenzoyl)-α-(5,5-dimethyl-2,4-dioxo-3-oxazolidinyl)-2-chloro-5-(n-pentadecylphenoxyacetamodeo)-acetanilide
54. α-Benzoyl-α-(2,4-dioxo-3-thiazolidinyl)-2-chloro-5-n-tetradecyloxycarbonylacetanilide
55. α-(α-Methoxyisobutyryl)-α-(2,4-dioxo-1,3-benzoxazinyl)-2-chloro5-[γ-(2,4-di-tert-amylphenoxybutyramido]acetanilide
56. α-Pivaloyl-α-(2,5-dioxo-3,4-trimethylene-1-imidazolidinyl)-2-chloro-5-[γ-(2,4-di-tert-amylphenoxypropyl)sulfamoyl]-acetanilide
57. α-Benzoyl-α-N-(2-pyridone)-2-methoxy-5-n-tetradecyloxy-carbonylacetanilide
58. α-Benzoyl-α-(1-benzyl-5-iso-propylidene-3-hydantoinyl-2-methoxy-5-[α-(3-n-butyl-4-hydroxyphenoxy)-n-tetradecanamido]acetanilide.

The alpha mono-substituted acylacetanilide coupler of general formula (V) used in this invention can be prepared by monohalogenating an acylacetamide represented by the formula (VI);

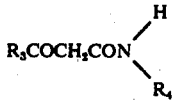

(VI)

using chlorine or bromine and then reacting the product and the salt of an acid HX, where X has the same meaning as $Z_4$ described for the general formula (V), with an organic or inorganic base, e.g., triethylamine, pyridine, sodium hydroxide, potassium hydroxide, etc., in a polar organic solvent, e.g., dimethylformamide, dimethyl sulfoxide, etc. Typical examples of the preparation of these couplers are described in the specifications of U.S. Pat. Nos. 3,277,155; 3,408,194; and 3,447,928; and German Patent Application OLS 2,057,941; and Japanese Pat. Application Nos. 15,997/1971 and 3039/1972.

Each of these couplers can be incorporated in a photographic emulsion using well-known methods and, in particular, it is desirable that the coupler is initially dissolved in an organic solvent such as dibutyl phthalate or tricresyl phosphate, the solution is dispersed in an aqueous medium such as an aqueous gelatin solution, and then the dispersion is added to a photographic emulsion.

The multilayer color photographic material has, as described before, at least two photosensitive emulsion layers each containing a coupler and it is desirable that the color photographic material has, in particular, a blue-sensitive silver halide emulsion layer, a green-sensitive silver halide emulsion layer, and a red-sensitive silver halide emulsion layer and further it is desirable that the blue-sensitive silver halide emulsion layer contains a yellow coupler, the green-sensitive silver halide emulsion layer contains a magenta coupler, and the red-sensitive silver halide emulsion layer contains a cyan coupler, although the mode of the color photographic material used in this invention is not limited to this embodiment.

It is further desirable that the support is coated with, in succession, the red-sensitive silver halide emulsion layer, the green-sensitive silver halide emulsion layer, and the blue-sensitive silver halide emulsion layer, or that the blue-sensitive silver halide emulsion layer be disposed at an upper position with respect to the red-sensitive silver halide emulsion layer (in the direction of travel of incident exposure light). Also, if desired, a yellow filter layer, intermediate layers, a light filter layer, an antihalation layer, and a protective layer can be further formed on the support.

In the fogged emuslion layer of the color photographic material used in this invention, a yellow coupler, a magenta coupler, and a cyan coupler can be used individually or as a combination of these couplers. Also, the fogged emulsion layer can further contain, in addition to the aforesaid coupler, a coupler capable of providing a desired color, for instance, a coupler capable of providing a red, purple, or grey color. Typical examples of these couplers which can be used in the fogged emulsion layer are as follows:

59. 1-(2,4,6-Trichlorophenyl)-3-{N-acetyl-2-chloro-5-[γ-(2,4-di-tert-amylphenoxy)-butyramido]anilino}-5-pyrazolone
60. 1-(2,4,6-Trichlorophenyl)-3-{N-acetyl-4-[ -(2,4-di-tert-amylphenoxy)butyramido]anilino}-5-pyrazolone
61. 1-(2,4,6-Trichlorophenyl)-3-(N-acetyl-4-n-tetradecane-amidoanilino)-5-acetoxypyrazole
62. 1-(2,4-Dimethyl-6-chlorophenyl)-3-(N-butyryl-2-chloro-5-n-tretradecyloxycarbonylanilino)-5-pyrazolone
63, 1-(2,4,6-Trichlorophenyl-3-{N-acetyl-2-chloro-5-[α-(2,4-di-tert-amylphenoxy)-butyramido]anilino}-5-acetoxypyrazole 64. 1-(2,4,6-Trichlorophenyl-3-{N-{3-[α(2,4-di-tert-amylphenoxy)butyramido]benzoyl}anilino}-5-pyrazolone
65. 1-[4-(3-n-Pentadecylphenoxyacetamido)-phenyl]-3-(N-acetyl-2-methoxy-5-ethyl-sulfamoylanilino)-5-pyrazolone
66. 1-{4-[α-(2,4-Di-tert-amylphenoxy)butyramido]-phenoxy}-3-(M-acetyl-3,5-di-n-butoxycarbonylanilino)-5-pyrazolone
67. 1-(2,4,6-Trichlorophenyl)-3-{N-acetyl-2-chloro-5-[α-2,4-di-tert-amylphenoxy)-butyramido]anilino}-5-pyrazolone
68. α-Cyano-3-[α-(2,4-di-tert-amylphenoxy)-butyramido]acetophenone
69. α-Cyano-3-[γ-(3-n-pentadecylphenoxy)-butyramido]-4-methoxyacetophenone
70. 1-Benzyl-3-[N-acetyl-4-(3-n-pentadecylphenoxyacetamido)-anilino]-5-pyrazolone
71. 1-(2,4,6-Trichlorophenyl)-3-{1,3-dioxo-5-[α-(2,4-di-tert-amylphenoxy)butyramido]-2-isoindolyl}-5-pyrazolone
72. 1-(2,4,6-Trichlorophenyl)-3-{1,3-dioxo-5-[α-(3-n-pentyloxyphenoxy)-n-tetradecaneamido-2-isoindolinyl}-5-propionoxyrazole The position of the fogged emulsion layer in the layers of the multilayer color photographic material formed can be optionally selected but it is advantageous from the standpoints of sharpness and less light scattering by the grains of water insoluble metal salts in the fogged emulsion layer that the fogged emulsion layer be near the support. In particular, better results are obtained when the fogged emulsion layer is formed at the closest to the support than the photosensitive silver halide emulsion layers although the position of this layer is not limited to this embodiment in this invention.

The fog density of the fogged emulsion layer depends upon the nature of the fogged emulsion, the kind of the couplers used, and the amounts of couplers coated but it is preferred that the density of the fogged emulsion layer measured at the maximum absorption wavelength of the colored dyes after developing the multilayer color photographic material range from about 0.1 to 2.0 although the invention is not always limited to this range.

The silver halide emulsions used for the photosensitive emulsion layers of the color photographic material used in this invention are explained below in detail.

The silver halide emulsion is usually prepared by mixing an aqueous solution of a water-soluble silver salt such as silver nitrate and an aqueous solution of a water-soluble halide such as potassium bromide in the presence of an aqueous solution of a water-soluble polymer such as gelatin. Suitable silver halides for the silver halide emulsion are silver chloride, silver bromide, silver chlorobromide, silver iodobromide, and silver chloroiodobromide. In the present invention, however, silver iodobromide or silver chloroiodobromide is particularly useful, and in particular, a silver halide containing about 0.1 to 20 mole percent iodide and less than about 10 mole percent chloride is preferred. The grain size of the silver halide need not always be uniform. Usually, silver halide grains in which more than 50% thereof have a mean grain size of about 0.1 to 2 microns are used. These silver halide grains are prepared using conventional techniques, preferably using a so-called single jet method, twin jet method, or control twin jet method.

Furthermore, two or more kinds of silver halide photographic emulsions prepared separately can be mixed. Still further, the silver halide used in this invention can be one having a uniform crystal structure throughout the entire crystal, one having a structure where the outer layer has a different characteristic from the inside of the crystal, or a so-called conversion-type silver halide as described in the specifications of British Pat. No. 635,841 and U.S. Pat. No. 3,622,318. Also, the silver halide emulsion can be the type where latent images are mainly formed on the surface of the grains or the type where latent silver halide emulsions can also be prepared by various methods such as an ammonia method, a neutralization method, an acidic method, etc., as used in general and described in, for instance, C. E. K. Mees & T. H. James, *The Theory of the Photographic Process*, published by MacMillan Co.; Grafkides, *Chimie Photographique*, published by Paul Montel Co. (1957), etc.

After the preparation of such silver halide grains as described above, the by-produced water-soluble salts (e.g., potassium nirate when silver bromide is prepared using silver nitrate and potassium bromide) are removed from the system by water washing and then the silver halide grains are subjected to heat treatment in the presence of a chemical sensitizer such as sodium thiosulfate, N,N,N'-trimethylthiourea, a thiocyanate complex salt of mono-valent gold, a thiosulfate complex salt of mono-valent gold, stannous chloride, hexamethylene tetramine, etc., to increase the sensitivity of them without coarsening the grain size. These techniques are also generally described in the aforesaid references.

The silver halide emulsions described above can be also chemically sensitized in an ordinary manner. Examples of chemical sensitizers which can be used for this purpose are, for instance, gold compounds such as the auric chloride and gold trichloride as described in the specifications of U.S. Pat. Nos. 2,339,083; 2,540,085; 2,597,856; and 2,597,915; the salts of plantinum, palladium, iridium, rhodium, and ruthenium as described in the specifications of U.S. Pat. Nos. 2,448,060; 2,540,086; 2,566,245; 2,566,263; and 2,598,079; sulfur compounds which form silver sulfide by reaction with silver salts as described in the specifications of U.S. Pat. Nos. 1,574,944; 2,410,689; 3,189,458; and 3,501,313; and the stannous salts, amines and other reduction sensitizers as described in the specifications of U.S. Pat. Nos. 2,487,850; 2,518,678; 2,521,925; 2,521,926; 2,694,637; 2,983,610; and 3,201,254.

As a fogged emulsion used for the fogged emulsion layer of the color photographic material to be processed by the process of this invention, an emulsion of a water-insoluble metal salt which can be developed by an aromatic primary amino color developing agent without light exposure can be used with better results. Particularly preferred examples of such metal salts are silver chloride, silver bromide, silver iodide, silver chlorobromide, silver iodobromide, and silver chloroiodobromide but other silver salts than these silver halides, such as silver citrate, silver oxalate, silver stearate, silver ferrocyanate, and silver thiocyanate, and palladium bromide, palladium cyanate, and cuprous bromide can also be used. A suitable weight ratio of the water-insoluble metal salt to the hydrophilic colloid can range preferably from about 4:1 to 1:250 and the particle size is not limited but generally ranges from about 0.01 μ to 4 μ, preferably 0.05 μ to 0.5 μ. A suitable amount of the water insoluble metal salt ranges from about 0.1 mg to 50 mg, preferably 0.5 mg to 20 mg, per 100 $cm^2$ of the emulsion layer.

The method of providing these water-insoluble metal salts with the property that can be developed without light exposure includes two methods as described in the specifications of U.S. Pat. Nos. 2,694,008; 2,712,995; 3,227,554; 3,227,551; and 3,364,022 and both methods can be employed in this invention with good results.

That is, the first method is a method in which well-known physical development nuclei are incorporated in the metal salt emulsion. Typical examples of physical development nuclei are a colloidal noble metal such as colloidal silver and colloidal gold; a colloidal metal sulfide, selenide, and telluride such as lead sulfide, nickel sulfide, copper sulfide, cadmium sulfide, silver sulfide, zinc sulfide, mercury sulfide, silver selenide, silver telluride, etc.; a reaction product of a metal and a protein; sodium sulfide; colloidal sulfur; and an organic sulfur compound such as thiourea. When physical development nuclei are incorporated in the metal salt emulsion so that the emulsion can be developed in situ without the need of light exposure, a well-known solvent for the metal salt, such as a thiosulfate, a thiocyanate, and a sulfite can be added to the developer. A suitable weight ratio for the physical development nuclei to the emulsion ranges from about 1:10,000 to 1:1, preferably 1:5,000 to 1:2. The particle size of the physical development nuclei is not restricted and a suitable particle size generally ranges from about 0.005 to 1 μ, preferably 0.005 to 0.1 μ.

The second method is one wherein a photosensitive metal salt such as a silver halide is fogged optically or chemically. In the case of chemical fogging, the emulsion can be fogged with excess sulfur of gold sensitization of using a reducing agent such as, for instance, stannous chloride, an amine, sodium borohydride, etc.

In the layers of the multilayer color photographic material to be processed by the process of this invention, such as the photosensitive silver halide emulsion layers, the fogged emulsion layer, intermediate layers, a protective layer, etc., a hydrophilic colloid can be employed.

Examples of hydrophilic colloids are, for instance, gelatin; colloidal albumin; casein; a cellulose derivative such as carboxymethyl cellulose and hydroxymethyl cellulose; agar agar; sodium aliginate; a starch derivative; and a synthetic hydrophilic colloid such as polyvinyl alcohol, poly-N-vinylpyrrolidone, a polyacrylic acid copolymer, polyacrylamide and the derivatives or partially hydrolyzed products thereof. These colloids can be used individually or, if desired, as a compatible mixture of two or more such colloids. Of the aforesaid materials, gelatin is most generally used but the gelatin can be at least partially be replaced with a synthetic polymer or can be replaced with a so-called gelatin derivative, that is, gelatin modified by treatment with a compound having a group capable of reacting with the functional groups of the gelatin molecule, such as an amino group, an imino group, a hydroxyl group, and a carboxyl group or further can be replaced with a graft polymer prepared by bonding the molecular chain of another polymer to gelatin.

Examples of the compounds for preparing the abovedescribed gelatine derivatives includes the isocyanates, acid chlorides, and acid anhydrides as described in the specification of U.S. Pat. No. 2,614,928, the bromoacetic acids as described in the specification of Japanese Patent Publication No. 26,845/1967, the acid anhydrides as described in the specifications of U.S. Pat. No. 3,118,766, the phenyl glycidyl ethers as described in Japanese Patent Publication No. 26,845/1967, the vinylsulfone compounds as described in U.S. Pat. No. 3,132,945, the N-allylvinylsulfonamides as described in British Pat. No. 861,414, the maleinimide compounds as described in U.S. Pat. No. 3,186,846, the acrylonitriles as described in U.S. Pat. No. 2,594,293, the polyalkylene oxides as described in U.S. Pat. No. 3,312,553, the epoxy compounds as described in Japanese Patent Publication No. 26,845/1967, the esters of the acids as described in U.S. Pat. No. 2,763,639, and the alkanesultones as described in British Pat. No. 1,033,189.

Also, examples of the chain polymers which can be grafted to gelatin for preparing the above-described graft polymers are described in U.S. Pat. Nos. 2,763,625; 2,831,767; and 2,956,884 as well as Polymer Letters, 5, 595 (1967), Phot. Sci. Eng., 9, 148 (1965), and J. Polymer Sci., A-1, 9, 3199 (1971) but the polymers or copolymers of the so-called vinyl monomers such as acrylic acid, methacrylic acid, the esters, amides, and nitriles of these acids, and styrene can be widely used for the aforesaid purposes. However, it is particularly desirable to use a hydrophilic vinyl polymer having some compatibility with gelatin, such as a polymer or copolymer of acrylic acid, acrylamide, methacrylamide, a hydroxyalkyl acrylate, a hydroxyalkyl methacrylate, etc.

Each of the silver halide photosensitive emulsions used for the color photographic material in this invention can be spectrally sensitized and/or super sensitized with a cyanine dye such as cyanine, merocyanine, carbocyanine, etc., or a combination of these cyanine dyes or further a combination of a cyanine dye and a styryl dye. These spectral sensitization techniques are well known and are described in, for instance, the specifications of U.S. Pat. Nos. 2,493,748; 2,519,001; 2,977,229; 3,480,434; 3,672,897; 3,703,377; 2,688,545; 2,912,329; 3,397,060; 3,615,635; and 3,628,964; British Pat. Nos. 1,195,302; 1,242,588 and 1,203,962; German Patent Application OLS 2,030,326 and 2,121,780; Japanese Patent Publication Nos. 4936/1968; 14,030/1969 and 10,733/1968; U.S. Pat. Nos. 3,511,664; 3,522,052; 3,527,641; 3,615,613; 3,615,632; 3,617,295; 3,635,721; and 3,694,217; and British Pat. Nos. 1,137,580 and 1,216,203. They can be selected according to the wavelength regions to be sensitized, the sensitivity desired, and the end use purpose of the color photographic material.

The above-described layers of the multilayer color photographic material to be processed by the process of this invention, such as the photosensitive emulsion layers, the intermediate layers, the protective layer, etc., can further contain various compounds for preventing reduction in sensitivity and formation of fog during the production, storage and processing of the color photographic material. Examples of such compounds include various heterocyclic compounds such as, for instance, 4-hydroxy-6-methyl-1,3,3a,7-tetraazaindene, 3-methyl-benzothiazole, 1-phenyl-5-mercaptotetrazole, etc.; mercury-containing compounds, mercapto compounds, and metal salts. Specific examples of these compounds are described in C. E. K. Mees & T. H. James, *The Theory of the Photographic Process*, 3rd Ed., Macmillan, New York, (1966) as well as in the specifications of U.S. Pat. Nos. 1,758,576; 2,110,178; 2,131,038; 2,173,628; 2,697,040; 2,304,962; 2,324,123; 2,394,198; 2,444,605; 2,444,606; 2,444,607; 2,444,608; 2,566,245; 2,694,716; 2,697,099; 2,708,162; 2,728,663; 2,728,664; 2,728,665; 2,476,536; 2,824,001; 2,843,491; 2,886,437; 3,052,544; 3,137,577; 3,320,839; 3,226,231; 3,236,652; 3,251,691; 3,252,799; 3,287,135; 3,326,681; 3,420,668; 3,622,339; and British Pat. Nos. 893,428; 403,789; 1,173,609 and 1,200,188.

The above-described silver halide photosensitive emulsion layers, the fogged emulsion layer, intermediate layers, and protective layer can contain a surface active agent or a mixture of surface active agents. The surface active agent is usually used as a coating aid but sometimes it is used for other purposes, e.g., the improvement of dispersion, sensitivity, and photographic characteristics and also static prevention and adhesion prevention.

Suitable surface active agents which can be used for these purposes are natural surface active agents such as saponin; nonionic surface active agents such as alkylene oxides, glycerins, and glycidols; cationic surface active agents such as higher alkylamines, quaternary ammonium salts, pyridine and other heterocyclic compounds, phosphoniums, and sulfoniums; anionic surface active agents containing an acid group such as a carboxylic acid group, a sulfonic acid group, a phosphoric acid group, a sulfuric acid ester group, and a phosphoric acid ester group; and amphoteric surface active agents such as aminoacids, aminosulfonic acids, aminoalcohol sulfuric acid esters, and aminoalcohol phosphoric acid esters. Some of these surface active agents are described in the specifications of U.S. Pat. Nos. 2,271,623; 2,240,472; 2,288,226; 2,739,891; 3,068,101; 3,158,484; 3,201,253; 3,210,191; 3,294,540; 3,415,649; 3,441,413; 3,442,654; 3,475,174; 3,545,974; and 3,666,478; German Patent Application OLS 1,942,665; and British Pat. Nos. 1,077,317 and 1,198,450 as well as Ryohei Oda, Kaimen Kasseizai no Gosei to sono Oyo (Synthesis and Application of Surface Active Agents), published by Maki Shoten in 1964; A. W. Perry, Surface Active Agents, published by Interscience Publication Incorp. in 1958; and J. P. Sisley, Encyclopedia of Surface Active Agents, Vol. 2, published by Chemical Publishing Co. in 1964.

The photosensitive emulsion layers, fogged emulsion layer, intermediate layers, protective layer, etc., of the multilayer color photographic material used in this invention can be hardened using a hardening agent. Preferred examples of hardening agents are aldehyde compounds such as formaldehyde and glutaraldehyde; ketone compounds such as diacetyl and cyclopentadione; reactive halogen compounds such as bis(2-chloroethylurea), 2-hydroxy-4,6-dichloro-1,3,5-triazine and the compounds as described in the specifications of U.S. Pat. Nos. 3,288,775 and 2,732,303 and British Pat. Nos. 974,723 and 1,167,207; reactive olefin compounds such as divinylsulfone, 5-acetyl-1,3-diacrolylhexahydro-1,3,5-triazine, and the compounds as described in the specifications of U.S. Pat. Nos. 3,635,718 and 3,232,763 and British Pat. No. 994,869; N-methylol compounds such as N-hydroxymethylphthalimide and the compounds as described in the specifications of U.S. Pat. Nos. 2,732,316 and 2,586,168; the isocyanates as described in the specification of U.S. Pat. No. 3,103,437; the aziridine compounds as described in the specifications of U.S. Pat. Nos. 3,017,280 and 2,983,611; the acid derivatives as described in the specifications of U.S. Pat. Nos. 2,725,294 and 2,725,295; the carbodiimide compounds as described in the specification of U.S. Pat. No. 3,100,704; the epoxy compounds as described in the specification of U.S. Pat. No. 3,091,537; the isooxazole compounds as described in the specifications of U.S. Pat. Nos. 3,321,313 and 3,543,292; halocarboxyaldehydes such as mucochloric acid; dioxane derivatives such as dihydroxydioxane; and inorganic hardening agents such as chromium alum and zirconium sulfate. Furthermore, in place of the aforesaid compounds, precursors such as, for instance, an alkali metal bisulfite-aldehyde adducts, a methylol derivative of hydantoin, and a primary aliphatic nitro alcohol can be also used.

The support used for the multilayer color photographic material used in this invention is a substantially planar material which does not undergo severe dimensional change during processing, such as glass plates, metallic sheets, rigid supports, and flexible supports. Typical examples of flexible supports are a cellulose nitrate film, a cellulose acetate film, a cellulose acetate butyrate film, a cellulose acetate propionate film, a polystyrene film, a polyethylene terephthalate film, a polycarbonate film, laminates of these polymer films, a thin glass film, a baryta-coated paper, a paper coated with an alphaolefin polymer such as polyethylene, polypropylene, an ethylenebutene copolymer, and a plastic film whose surface is matted to improve the adhesive properties with other polymers and to improve the printability as described in Japanese Patent Publication No. 19,068/1972.

The support can be transparent or opaque according to the end use purpose of the multilayer color photographic material. Furthermore, in the case of using a transparent support, the support can be colored by adding a dye or pigment. Such a technique is used for X-ray films or radiographic films and is described in, e.g., J.S.M.P.T.E., 67,296 (1958).

The opaque support can be a paper, a plastic film prepared by adding a dye or a pigment such as titanium oxide to a transparent plastic film followed by surface treatment as shown in Japanese Patent Publication No. 19,068/1972, and a plastic film or paper containing carbon black.

If the adhesivity between the support and the photographic emulsion layer is insufficient, a subbing layer having good adhesivity to both the support and the emulsion layer can be formed on the support surface or further for improving the adhesivity, the surface of the support can be subjected to a pretreatment such as a corona discharge, an ultraviolet light irradiation, and a flame treatment.

The coating compositions for the photographic layers of the color photographic material can be coated on the aforesaid support using various coating methods including dip coating, air knife coating, curtain coating, and an extrusion coating using a hopper as described in the specification of U.S. Pat. No. 2,681,294. If desired, two or more layers can be coated simultaneously using the method as described in the specifications of U.S. Pat. Nos. 2,761,791; 3,508,947; 2,941,898; and 3,526,528.

When a multilayer color photographic material as described above in detail is developed at temperatures higher than about 30° C, the objects of this invention described hereinbefore are effectively attained. Particularly improved results are obtained by developing the color photographic material at temperatures of from about 30° C to about 80° C but higher temperatures than about 80° C, e.g., up to about 100° C, can be also employed. In the case of developing the multilayer color photographic material according to the process of this invention, a pre-treatment bath, a bleach bath, a fix bath, and a stabilization bath are usually used in addition to the color development bath.

The objects of this invention are effectively attained by conducting the color development only at temperatures higher than about 30° C, in other words, the processing steps other than the color development can be carried out at any desired temperatures.

The above-described multilayer color photographic material is color-developed using an aromatic primary amine compound such as a p-phenylenediamine derivative. Typical examples of color developing agents which can be used in this invention are the inorganic acid salts of N,N-diethyl-p-phenylenediamine, 2-amino-5-diethylaminotoluene, 2-amino-5-(N-ethyl-N-laurylamino)toluene, 4-[N-ethyl-N-(β-hydroxyethyl-)amino]aniline, 3-methyl-4-amino-N-ethyl-N-(β-hydroxyethyl)aniline, etc.; 4-amino-3-methyl-N-ethyl-N-(β-methanesulfoamidoethyl)-anilinesesquisulfate monohydrate as described in the specification of U.S. Pat. 2,193,015; N-[2-amino-5-diethylaminophenylethyl)methanesulfoamido]sulfate and N,N-dimethyl-p-phenylenediamine hydrochloride as described in the specification of U.S. Pat. No. 2,592,364; and 3-methyl-4-amino-N-ethyl-N-methoxyethylaniline as described in the specification of Japanese Patent Application Laid Open No. 64,933/1973. Suitable color developing agents are described in detail in L. F. A. Mason, *Photographic Processing Chemistry*, pages 226 ~ 229, Focal Press, London (1966), and they can be used, if desired, together with 3-pyrazolidones.

The color developer used in the process of this invention can further contain various additives, if desired. Typical examples of such additives are an alkali (such as an alkali metal or ammonium hydroxide, carbonate, and phosphate), a pH controlling agent or a buffer (such as acetic acid, boric acid, and a weak base or salt thereof), a development accelerator (such as the pyridinium compounds and the cationic compounds as described in U.S. Pat. Nos. 2,648,604 and 3,671,247; potassium nitrate; sodium nitrate; the polyethylene glycol condensates and derivatives thereof as described in U.S. Pat. Nos. 2,533,990; 2,577,127; and 2,950,970; nonionic compounds as polythioethers as described in British Pat. Nos. 1,020,033 and 1,020,032; the polymer compounds containing a sulfite ester group as described in U.S. Pat. No. 3,068,097; organic amines such as pyridine and ethanolamine; benzyl alcohol; and hydrazine), an antifoggant (such as, an alkali metal bromide; an alkali metal iodide; the nitrobenzimidazoles as described in U.S. Pat. Nos. 2,496,940 and 2,656,271; mercaptobenzimidazole; 5-methylbenztriazole; 1-phenyl-5-mercaptotetrazole; the compounds for quick processing as described in U.S. Pat. Nos. 3,113,964; 3,342,596; 3,615,522; 3,295,976; and 3,597,199; thiosulfonyl compounds as described in British Pat. No. 972,211; the phenazine-N-oxides as described in Japanese Patent Publication No. 41,675/1971; and other antifoggants as described in *Shashin Kagaku Binran* (*Handbook of Photographic Science*), Vol. II, pages 29 ~ 47), the stain or sludge prevention agents as described in U.S. Pat. Nos. 3,161,513 and 3,161,514 and British Pat. Nos. 1,030,442; 1,144,481; and 1,251,558; and further the multilayer effect accelerators and preservatives as described in U.S. Pat. No. 3,536,587 (such as a sulfite, a bisulfite, hydroxyamine hydrochloride, formaldehyde-bisulfite, and alkanolmine-sulfite addition products).

The invention will be further explained by reference to the following examples. Unless otherwise indicated, all parts, percents, ratios and the like are by weight.

EXAMPLE 1

Multilayer color Photographic Material (A) was prepared by coating, in succession, on a cellulose triacetate film support the following layers:

First Layer: Red-sensitive silver halide emulsion layer

A gelatino silver iodobromide high-sensitive emulsion (containing 5 mole% silver iodide; weight ratio of silver to gelatin: 1:1.5) rendered red-sensitive with a sensitizing dye and Cyan Forming Coupler (13) were coated at a coverage of 30 mg/100 cm² of silver and 6.8 mg/100 cm² of the coupler.

Second Layer: An intermediate layer mainly comprising gelatin

Third Layer: Green-sensitive silver halide emulsion layer

A high-sensitive gelatino silver iodobromide emulsion (the silver iodide content and the silver/gelatin ratio were same as those in the first layer) and Magenta Forming Coupler (7) were coated at a coverage of 25 mg/100 cm² of silver and 5.3 mg/100 cm² of the coupler.

Fourth Layer: Yellow filter layer

A yellow colloidal silver dispersion in a gelatin solution was coated at a coverage of 2.5 mg/100 cm² of silver.

Fifth Layer: Blue-sensitive silver halide emulsion layer

A high-sensitive gelatino silver iodobromide emulsion (the silver iodide content and the silver/gelatin ratio were same as those of first layer) and Yellow Forming Coupler (1) were coated at a coverage of 20 mg/100 cm² of silver and 9.8 mg/100 cm² of the coupler.

In the above cases, each of the couplers used in the first, second, and third layers was first dissolved in tricresyl phosphate, the coupler solution was dispersed by emulsification in an aqueous gelatin solution, and the dispersion was added to the silver halide photographic emulsion before coating.

Furthermore, 4-hydroxy-6-methyl-1,3,3a,7-tetraazaindene was further added to the coating compositions for the first, third, and fifth layers as a stabilizer and also sodium dodecylbenzenesulfonate and triacrolylhexahydrotriazine were added to the coating compositions for the first, second, third, fourth, and fifth layers as a coating aid and a hardening agent, respectively.

Multilayer Color Photographic Material (B) was prepared by the same procedure as in the case of preparing Photographic Material (A) except that a fogged layer was formed between the support and the red-sensitive silver halide emulsion layer by coating on the support a coating composition containing a silver iodobromide emulsion (the silver iodide content and the silver/gelatin ratio were same as in the first layer of Photographic Material (A)) which was fogged by adding thereto 10 mg of sodium thiosulfate per mole of AgX and then chemically ripening for one hour at 80° C and Magenta Forming Coupler (7) at a coverage of 4 mg/100 cm² of silver and 1.5 mg/100 cm² of the coupler.

Multilayer Color Photographic Material (C) was prepared by the same procedure as in the case of preparing Photographic Material (B) except that the fogged emulsion layer was coated at a coverage of 12 mg/100 cm² of silver and 4.5 mg/100 cm² of the coupler.

Multilayer Color Photographic Material (D) was prepared by the same procedure as in the case of preparing Photographic Material (B) except that the fogged emulsion layer was coated at a coverage of 28 mg/100 cm² of silver and 27.8 mg/100 cm² of the coupler.

Each of Photographic Materials (A) to (D) thus prepared was exposed to red light through an optical wedge and then subjected to the following processing:

| Processing Step | Temperature | Time |
|---|---|---|
| Color development | shown below | shown below |
| Stop | 38° C | 1 min |
| Wash | " | 1 min |
| Bleach | " | 2 min |
| Wash | " | 1 min |
| Fix | " | 2 min |
| Wash | " | 1 min |
| Fix | " | 1 min |

The processing solutions used in the above processing steps had the following compositions:

| | |
|---|---|
| Color Developer | |
| Sodium Hydroxide | 2 g |
| Sodium Sulfite | 2 g |
| Potassium Bromide | 0.4 g |
| Sodium Chloride | 1 g |
| Borax | 4 g |
| Hydroxylamine Sulfate | 2 g |
| Di-sodium Ethylenediamine Tetraacetate (di-hydrate) | 2 g |
| 4-Amino-3-methyl-N-ethyl-N-(β-hydroxyethyl)aniline . monosulfate | 4 g |
| Water to make | 1 l |
| Stop Solution | |
| Sodium Thiosulfate | 10 g |
| Ammonium Thiosulfate (70% aqueous solution) | 30 ml |
| Acetic Acid | 30 ml |
| Sodium Acetate | 5 g |
| Potassium Alum | 15 g |
| Water to make | 1 l |
| Bleach Bath | |
| Sodium Ferric Ethylenediamine Tetraacetate (di-hydrate) | 100 g |
| Potassium Bromide | 50 g |
| Ammonium Nitrate | 50 g |
| Boric Acid | 5 g |
| Aqueous Ammonia (for adjusting the pH to 5.0) | |
| Water to make | 1 l |
| Fix Solution | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make | 1 l |
| Stabilization Bath | |
| Boric Acid | 5 g |
| Sodium Citrate | 5 g |
| Sodium Metaborate (4 $H_2O$) | 3 g |
| Potassium Alum | 15 g |

-continued

| | |
|---|---|
| Water to make | 1 l |

In addition, the color development was conducted at 38° C for 3 minutes. The densities of the materials thus processed were measured by means of a spectrophotometer. That is, the density at a wavelength of 650 nm and the density at the wavelength of 550 nm corresponding thereto were measured and the results are shown in Table 1.

In Table 1, the degree of sub-absorption is represented by the difference of the concentration at 550 nm in each measurement for an optical density of 2.00 and 0.10, respectively at 650 nm, i.e., this difference indicates how much of an increase is measured at 550 nm when an optical density increase of 1.90 due to an increase in the concentration of the cyan dye at 650 nm occurs (hereinafter the same).

TABLE 1

| | Photographic Material | | | | | | | |
|---|---|---|---|---|---|---|---|---|
| Wavelength | (A) | | (B) | | (C) | | (D) | |
| 650 nm | 0.10 | 2.00 | 0.10 | 2.00 | 0.10 | 2.00 | 0.10 | 2.00 |
| 550 nm | 0 | 0.22 | 0.10 | 0.28 | 0.45 | 0.52 | 2.00 | 2.05 |
| Density Increase at 550 nm | 0.22 | | 0.18 | | 0.07 | | 0.05 | |

As is clear from the results shown in Table 1, the increase of the side absorption density of the cyan image (the density at 550 nm) was high in Photographic Material (A) having no fogged emulsion layer but the increase was clearly low in Photographic Materials (B) to (D) having the fogged emulsion layer and the color reproduction was also clearly improved in the latter case.

EXAMPLE 2

Photographic Material (C) in Example 1 was exposed to a red light through an optical wedge and processed according to the above-described negative processing in Example 1. In this case, however, the color development was changed in four steps as shown in Table 2. After processing, the densities were measured as in Example 1 and the results are shown in the same table.

TABLE 2

| | 25° C 12 min | | 30° C 8 min | | 35° C 5 min | | 55° C 1.45 min | |
|---|---|---|---|---|---|---|---|---|
| Wavelength | | | | | | | | |
| 650 nm | 0.10 | 2.00 | 0.10 | 2.00 | 0.10 | 2.00 | 0.10 | 2.00 |
| 550 nm | 0.54 | 0.77 | 0.51 | 0.64 | 0.50 | 0.57 | 0.48 | 0.56 |
| Density Increase at 550 nm | 0.23 | | 0.13 | | 0.07 | | 0.08 | |

As is clear from the results shown in Table 2, by development at 25° C, the magenta density increased as in Photographic Material (A) in Example 1 together with the increase in the cyan density of the emulsion layer even if the fogged emulsion layer was formed in the color photographic material and further the effect of improving the color reproduction was not obtained but in the development at temperature higher than 30° C, the above tendency became less and color reproduction was confirmed to be improved.

EXAMPLE 3

Multilayer Color Photographic Material (E) was prepared by the same procedure as in the case of preparing Photographic Material (A) except that a fogged emulsion layer containing a silver bromide emulsion having a mean grain size of 0.1 micron, colloidal silver, and Coupler (64) was coated between the red-sensitive silver halide emulsion layer and the green-sensitive silver halide emulsion layer at a coverage of 6 mg/100 $cm^2$ of silver, 0.6 mg/100 $cm^2$ of colloidal silver, and 0.7 mg/100 $cm^2$ of the coupler.

Multilayer Color Photographic Material (F) was prepared by the same procedure as in the case of preparing Photographic Material (E) except that Coupler (4) was used in place of Coupler (1) in the blue-sensitive silver halide emulsion layer and the blue-sensitive silver halide emulsion layer was formed at a coverage of 12 mg/100 $cm^2$ of silver and 10.7 mg/100 $cm^2$ of the coupler.

Each of Photographic Materials (E) and (F) thus prepared was exposed to a minus green light, i.e., blue plus red light, through an optical wedge and then subjected to the aforesaid processings described in Example 1. In this case, however, the condition for the color development was as shown in Table 3.

TABLE 3

| | Photographic Material | | | | | | | |
|---|---|---|---|---|---|---|---|---|
| | (E) | | | | (F) | | | |
| | 25° C 12 min | | 35° C 5 min | | 25° C 12 min | | 35° C 5 min | |
| Wavelength | | | | | | | | |
| 650 nm | 0.10 | 2.00 | 0.10 | 2.00 | 0.10 | 2.00 | 0.10 | 2.00 |
| 550 nm | 0.32 | 0.50 | 0.34 | 0.35 | 0.35 | 0.60 | 0.36 | 0.39 |
| Density Increase at 550 nm | 0.18 | | 0.01 | | 0.25 | | 0.03 | |

As shown in Table 3, the effect of improving color reproduction, that is, the density increase at 550 nm when the photographic material having the fogged emulsion layer was developed at a high temperature was as high as 0.22 in the case of using Yellow Coupler (4) of which the alpha-position had been substituted (Photographic Material (F)) as compared with 0.17 in the case of using acylacetamido Yellow Coupler (1) in which the alpha-position had not been substituted (Photographic Material (E)) and further when Coupler (4) was used, the color reproduction effect was clearly high in the high temperature processing.

Then, the image sharpness of the aforesaid materials thus processed was measured.

That is, the measurement of the sharpness was carried out by determining the Modulation Transfer Function (MTF) and comparing the MTF values at a certain frequency value. The measurement of the MTF value was carried out according to the method described in Masao Takano and Ikuo Fujimura, *Hihakai Kensa* (*Nondestructive Testing*), Vol. 16, pages 472 ~ 482 (1967). The exposure was carried out using green light, that is, the measurement was conducted using a green filter. The development was practiced according to the procedures as described in Example 1. The MTF values thus obtained are shown in Table 4.

In Table 4 the MTF values are shown at the frequencies of 10 lines and 30 lines per mm and as the value increases, the faithfulness of the image at the precise portion is better, that is, the image sharpness is high.

TABLE 4

| | Photographic Material | | | |
|---|---|---|---|---|
| | (E) | | (F) | |
| Frequency Value | 25° C 12 min | 35° C 5 min | 25° C 12 min | 35° C 5 min |
| 10 lines/mm | 85 | 91 | 92 | 102 |
| 30 lines/mm | 29 | 33 | 36 | 43 |

The values in Table 4 are MTF values in %.

As shown in Table 4, Photographic Material (F) exhibited better image sharpness than Photographic Material (E). As described above, by processing Photographic Material (F) at 35° C, an image having excellent sharpness and good color reproduction was obtained.

Almost the same results were obtained when color couplers represented by general formulae (I) to (V) other than those used in Examples 1, 2 and 3 were used. Substantially the same results were obtained when development procedures other than the development procedure as shown in the examples were employed.

While the invention has been described in detail and with reference to specific embodiments thereof, it will be apparent to one skilled in the art that various changes and modifications can be made therein without departing from the spirit and scope thereof.

What is claimed is:

1. A process for forming color photographic images which comprises color developing at temperatures higher than about 30° C a multilayer color photographic material comprising a support having thereon at least two silver halide photosensitive emulsion layers each containing a coupler which can form a non-diffusible colored dye on coupling with the oxidation product of an aromatic primary amino color developing agent and, located either between said silver halide photosensitive emulsion layers or closer to the support than said layers, at least one fogged emulsion layer containing a coupler which can form a non-diffusible colored dye on coupling with the oxidation product of an aromatic primary amino color developing agent, said fogged emulsion layer containing either a water-soluble metal salt and physical development nuclei or an optically or chemically fogged silver halide, wherein at least one of said silver halide photosensitive layers is a blue-sensitive layer and contains an alpha mono-substituted acylamide yellow coupler represented by general formula (V);

$$R_3-CO-\underset{\underset{Z_4}{|}}{CH}-CO-NH-R_4 \qquad (V)$$

wherein $R_3$ represents a primary alkyl group having 1 to 18 carbon atoms, a secondary alkyl group, a tertiary alkyl group, an aryl group; $R_4$ represents an aryl group; and $Z_4$ represents a halogen atom, an acyloxy group, an aryloxy group, a heterocyclic aromatic carbonyloxy group, a sulfimido group, an alkylsulfoxy group, an arylsulfoxy group, a phthalimido group, a dioxoimidazolidinyl group, a dioxothiazolidinyl group, an indazolyl group, or a dioxothiazolidinyl group.

2. The process for forming color photographic images as set forth in claim 1, in which the couplers contained in said photosensitive emulsion layers and the fogged emulsion layer of the multilayer color photographic material are at least a combination of a magenta coupler represented by general formula (I);

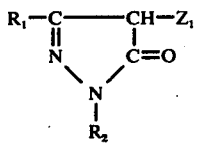

(I)

wherein $R_1$ represents a primary alkyl group, a secondary alkyl group, a tertiary alkyl group, an aryl group, a heterocyclic group, an amino group, a carbonamido group or a ureido group; $R_2$ represents an aryl group or a heterocyclic group; and $Z_1$ represents a hydrogen atom or a group releasable at color development;

a yellow coupler represented by general formula (II);

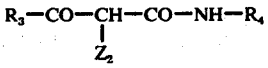

(II)

wherein $R_3$ represents a primary alkyl group having 1 to 18 carbon atoms, a secondary alkyl group, a tertiary alkyl group, or an aryl group; $R_4$ represents an aryl group; and $Z_2$ represents a hydrogen atom or a group releasable at color development; and a cyan coupler represented by the general formula (III) or (IV);

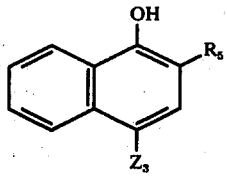

(III)

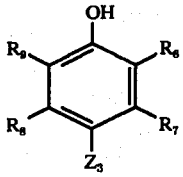

(IV)

wherein $R_5$ represents a carbamyl group, a sulfamyl group, an alkoxycarbonyl group, or an aryloxycarbonyl group; $R_6$ represents an alkyl group, an aryl group, a hetereocyclic group, an amino group, a carbonamido group, a sulfonamido group, a sulfamyl group, or a carbamyl group; $R_7$, $R_8$, and $R_9$ each represents the groups as defined for $R_6$ and further a halogen atom, or an alkoxy group; and $Z_3$ represents a hydrogen atom or a group releasable at color development.

3. The process of forming color photographic images as set forth in claim 1, in which the couplers contained in the photosensitive emulsion layers of the multilayer color photographic material are at least one of α-pivaloyl-α-phthalimido-2-chloro-5-[γ-(2,4-di-tert-amylphenoxy)butyramido]acetanilide, α-pivaloyl-α-(5,5-dimethyl-3-hydantoinyl)-2-chloro-5-[α-(2,4-di-tert-amylphenoxy)butyramido]acetanilide, α-pivaloyl-α-[4-(4-benzyloxybenzenesulfonyl)phenoxy]-2-chloro-5-[γ-(2,4-di-tert-amylphenoxy)butyramido]acetanilide, α-pivaloyl-α-(4-carboxyphenoxy)-2-chloro-5-[γ-(2,4-di-tert-amylphenoxy)butyramido]-acetanilide, α-pivaloyl-α-phthalimido-2-chloro-5-n-tetradechyloxycarbonylacetanilide, α-pivaloyl-α-acetoxy-2-chloro-5-[γ-(2,4-di-tert-amylphenoxy)butyramido]acetanilide, α-pivaloyl-α-(benzosulfimido)-2-chloro-5-[γ-(2,4-di-tert-amylphenoxy)butyramido]acetanilide, α-(α-p-toluoxyisobutyryl)-α-(N-succinimido)-2-chloro-5-[γ-(2,4-di-tert-amylphenoxy)butylsulfamoyl]acetanilide, α-benzoyl-α-phthalimido-2-methoxy-5-n-tetradecyloxycarbonylacetanilide, α- 3-[α-(2,4-di-tert-amylphenoxy)butyramido]-benzoyl -α-(1,3-dioxo-5-n-butyoxycarbonyl-2-isoindolinyl)-2-methoxyacetanilide, α-(2-methylbenzoyl)-α-phthalimido-2-chloro-5-n-dodecyloxycarbonylacetanilide, α-(2,4-dimethoxy)-α-(1,3-dioxo-5-carboxy-2-isoindolinyl)-2-chloro-5-N,N-dioctylsulfamoylacetanilide, α-benzoyl-α-(5,5-dimethyl-3-hydantoinyl)-2-chloro-5-n-dodecyloxycarbonylacetanilide, α-(2-methylbenzoyl)-α-(4-chlorophenoxy)-2-chloro-5-n-dodecyloxycarbonylacetanilide, α-(4-methoxybenzoyl)-α-(5,5-dimethyl-3-hydantoinyl)-2-chloro-5-[α-(2,4-di-tert-amylphenoxy)-butyramido]acetanilide, α-(4-methoxybenzoyl)-α-phthalimido-2-chloro-5-[α-(2,4-di-tert-amylphenoxy)-butyramido]acetanilide, α-(4-methoxybenzoyl)-α-(benzoylphthalimido)-2-chloro-5-[α-(2,4-di-tert-amylphenoxy)butyramido]-acetanilide, α-benzoyl-α-(2,5-dioxo-3-n-hexyl-1-pyrrolidinyl)-2-phenxoy-5-n-tetradecyloxycarbonylacetanilide, α- 4-methoxy-3-[α-(2,4-di-tert-amylphenoxy)butyramido]benzoyl -α-(N-phthalimido)-2-methoxy-5-(N,N-diethylsulfamoyl-)acetanilide, α-(4-methoxy-3-[α-(2,4-di-tert-amylphenoxy)butyramido]benzoyl-α-fluoro-2-methoxy-5-(N,N-diethylsulfamoyl)acetanilide, α-(4-methoxybenzoyl)-α-acetoxy-2-chloro-5-[2-(2,4-di-tert-amylphenoxy)-butyramido]acetanilide, α-benzoyl-α-[1,3-dioxo-5-(2,4-di-tert-amylphenoxyacetamido)-2-isoindolinyl]-2-methoxyacetanilide, α-pivaloyl-α-(1,3-dioxo-5-n-hexadecanamido-2-isoindolinyl)-2-benzthiazolylacetamide, α-(2-furoyl)-α-diglycolimido-2-chloro-4-[(β-n-valeryl-n-tridecylamino)propionamido]acetanilide, bis[α-terephthaloyl-α-phthalimido-2-methoxy-5-n-octyloxycarbonylacetanilide], 4,4'-methylenebis[α-(3-dodecanamidobenzoyl)-α-(4-benzyloxycarbonylphenoxy)-2-chloro-acetanilide], N,N'-bis[benzoyl-2-methoxy-5-(carbolaurylox-y)phenylcarbamylmethyl]pyromelitdiimide, α-pivaloyl-α-(2,5-dioxo-3-n-octadecyl-1-pyrrolidinyl)-3,5-dicarboxyacetanilide, α-(4-methoxybenzoyl)-α-(5,5-dimethyl-2,4-dioxo-3-oxazolidinyl)-2-chloro-5-(n-pentadecylphenoxyacetamido)acetanilide, α-benzoyl-α(2,4-dioxo-3-thiazolidinyl)-2-chloro-5-n-tetradecyloxycarbonylacetanilide, α-(α-methoxyisobutyryl)-α-(2,4-dioxo-1,3-benzoxazinyl)-2-chloro-5-[γ-(2,4-di-tert-amylphenoxybutyramido]acetanilide, α-pivaloyl-α-(2,5-dioxo-3,4-trimethylene-1-imidazolidinyl)-2-chloro-5-[γ-(2,4-di-tert-amylphenoxypropyl)sulfamoyl]acetanilide, α-benzoyl-α-N-(2-pyridone)-2-methoxy-5-n-tetradecyloxycarbonylacetanilide, or α-benzoyl-α-(1-benzyl-5-isopropylidene-3-hydantoinyl)-2-methoxy-5-[α-(3-n-butyl-4-hydroxyphenxoy)-n-tetradecanamido]-acetanilide.

4. The process of forming color photographic images as set forth in claim 1, in which said multilayer color photographic material comprises at least a blue-sensitive silver halide emulsion layer, a green-sensitive silver halide emulsion layer, and a red-sensitive silver halide emulsion layer.

5. The process of forming color photographic images as set forth in claim 1, in which said multilayer color photographic material comprises, from the support side, a red-sensitive silver halide emulsion layer, a green-sensitive silver halide emulsion layer, and a blue-sensitive silver halide emulsion layer.

6. The process of forming color photographic images as set forth in claim 1, in which the fog density of said fogged emulsion layer ranges from about 0.1 to 2.0 when measured at the maximum absorption wavelength of the colored dyes after development.

7. The process of forming color photographic images as set forth in claim 1, in which at least one of said photosensitive emulsion layers is a silver iodobromide or silver chloroiodobromide emulsion and the iodide content is about 0.1 to 20 mole percent and the chloride content is less than about 10 mole percent.

8. The process of forming color photographic images as set forth in claim 1, in which said fogged emulsion layer contains a silver halide and at least one of a colloidal noble metal, a colloidal metal sulfide, a colloidal metal selenide, a colloidal metal telluride, a reaction product of sulfur and a protein, sodium sulfide, colloidal sulfur, and an organic sulfur compound.

9. The process of forming color photographic images as set forth in claim 1, in which said color developing of said multilayer color photographic material is at temperatures of from about 30° C to about 80° C.

10. The process of forming color photographic images as set forth in claim 1, wherein the couplers contained in said photosensitive emulsion layers and the fogged emulsion layer of the multilayer color photographic material include yellow couplers represented by the general formula (II)

$$R_3-CO-\underset{\underset{Z_2}{|}}{CH}-CO-NH-R_4 \qquad \text{(II)}$$

wherein $R_3$ represents a primary alkyl group having 1 to 18 carbon atoms, a secondary alkyl group, a tertiary alkyl group, or an aryl group; $R_4$ represents an aryl group; and $Z_2$ represents a group releasable at coupling.

11. The process of forming color photographic images as set forth in claim 10, wherein $Z_2$ represents a halogen atom, an acyloxy group, an aryloxy group, a heterocyclic aromatic carbonyloxy group, a sulfimido group, an alkylsulfoxy group, an arylsulfoxy group, a phthalimido group, an indazolyl group, a dioxothiazolidinyl group, an arylmonothio group, a heterocyclic thio group, a 1-benzotriazolyl group and a 1-benzodiazolyl group.

12. The process of forming color photographic images as set forth in claim 1, wherein said process is a process providing a negative image upon exposure to an original and subsequent development.

* * * * *